United States Patent [19]

Valentini

[11] Patent Number: 4,704,803

[45] Date of Patent: Nov. 10, 1987

[54] MULTI-ROLL WEB SUPPORT ARRANGEMENT

[75] Inventor: Jose E. Valentini, Hendersonville, N.C.

[73] Assignee: E. I. Du Pont de Nemours and Company, Wilmington, Del.

[21] Appl. No.: 889,469

[22] Filed: Jul. 25, 1986

[51] Int. Cl.[4] ..... F26B 5/16

[52] U.S. Cl. ..... 34/9; 34/95.3; 15/256.5

[58] Field of Search ..... 118/669, 670; 15/256.5, 15/256.6; 34/95, 95.3, 9

[56] References Cited

U.S. PATENT DOCUMENTS 3,296,710 1/1967 Krikorian ..... 34/95

FOREIGN PATENT DOCUMENTS 147319 1/1981 Fed. Rep. of Germany ..... 118/670

*Primary Examiner*—Larry I. Schwartz

[57] ABSTRACT

A coated web drive uses a cluster of support and blotting rollers, the latter being switch to contact the web and dry wet portions of the web which typically occur at splices.

15 Claims, 3 Drawing Figures

MULTI-ROLL WEB SUPPORT ARRANGEMENT

BACKGROUND OF THE INVENTION

This invention relates to web handling rolls, and, more particularly, to a blotting roller arrangement for preventing contamination of the web drive system by insufficently dried portion of a web.

Numerous products are produced through processes which involve coating a continuous web with a liquid composition, drying the web and subsequently winding up the dried web into a roll for further processing. Depending on the particular path that the web must follow during processing, it may be necessary or expeditious for the web's coated surface to contact rollers which guide the web along a given path. In such processes, it is improtant that the web be completely dried prior to contacting a roller or windup to prevent interroller and/or interweb contamination. If there are portions of the web that have not completely dried, the rollers will be contaminated and will in turn contaminate subsequent sections of the web as they pass over them. In cases where the webs are driven at high speeds, a large portion of the web may become unacceptably contaminated.

This contamination is a particular problem in the production of photosensitive film products, as for instance x-ray film sheets. In such production a web of polyester base is driven past an emulsion coating station where a liquid emulsion layer is coated onto the web. The web is then guided into a dryer, supported only on the uncoated, back side. At the dryer exit it follows a folded path typically through an inspection and accumulator section to a windup station.

In order to obtain the high coating speeds needed in today's competitive environment, it is essential that the coating operation be a continuous uninterrupted process. This is obtained by the use of complex equipment which splices the trailing edge of a web to the leading edge of another without stopping the web and its transport system.

Unfortunately since the splice is thicker than the single web thickness, it disrupts the coating process at the coating station. This disruption occurs because the coating station often comprises a coating head positioned at a very small distance from the web surface which distance may actually be less than the splice thickness. It is therefore necessary to pull the coating head away from the web just before a splice arrives at the coatng station and bring it back into position when the splice has passed through. This process, known as skip-in skip-out, breaks the coating bead between the coating head and the web. Until the head is reestablished and normal coating resumed, a heavier layer tends to be deposited on the web.

Since dryers are designed with a capacity adequate to dry the normal coating to the desired dryness, the heavier web coating due to the skip-in skip-out operation often is insufficiently dried. Some known methods to alleviate this problem are the use of a suction device adjacent the coating head which acts as a vacuum cleaner on demand to suction off excess fluid from the web surface. This, however, requires the placement of extraneous equipment near the coating station, where room is usually at a premium. Additionally, the suction tube must be cleaned after each operation to assure that there are no lingering specs of coating material which may dry out and impede the suctioning system. In the alternative, the drying capacity of the dryer may be increased to handle the excess material on the web. However, this is inefficient and can lead to excessive drying of the normal coating if not properly readjusted.

There is a need for a practical way to avoid contamination of the rollers in a web drive system downstream of a coating station.

SUMMARY OF THE INVENTION

This roller contamination problem may be alleviated by the method of this invention which comprises the steps of: passing a moving web over a first support means, determining when an incompletely dried portion of the moving web passes over the first support means, and blotting the web by substituting a blotting means for the first support means during the period the incompletely dried portion passes over the first support means.

The first support means and the blotting means may together form a cluster of at least three rollers and preferably a cluster of two supporting and two blotting rollers. The blotting rollers are adjacent to each other and comprise a removable surface which may be cotton or polyester.

In implementing the above method, a system may be employed for supporting a coated web and reducing cross contamination of the web by incompletely dried portions of the web, the system comprising a first support means for the web, and means for substituting a blotting means for the first support means during the period of time that the incompletely dried portions of the web normally pass over the first support means. The system may further include determining means for generating a signal indicative of the passage of the incompletely dried portions over the first support means. The first support means and the blotting means together may form a cluster of at least three and preferably four rollers. In the latter case, the cluster includes two support and two blotting rollers, the blotting rollers being adjacent each other. The support means and blotting means may form a pivotal cluster of at least three rollers at least one of which has a blotting surface.

Finally, in order to automate the operation of the device, means are provided for generating a signal indicative of the passage of the incompletely dried portions of web past the first support means and selectively contacting the "wet" portions of the web with a roller haiing a blotting surface in response to the signal.

DESCRIPTION OF THE DRAWINGS

The invention will best be understood with reference to the attached drawings in which.

DETAILED DESCRIPTION OF THE INVENTION

The invention will now be described fully with reference to the accompanying drawings in which similar numbers indicate similar features in the various figures.

Figure 1:
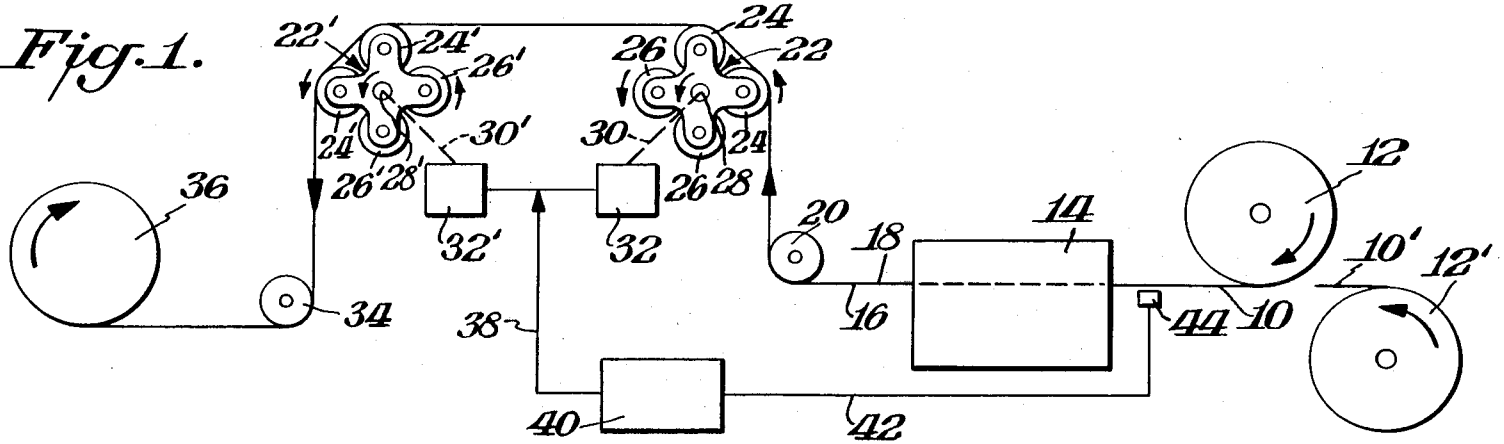
FIG. 1 is a simplified schematic representation of a typical web handling system employing blotting rollers constructed in accordance with this invention.
Figure 3:
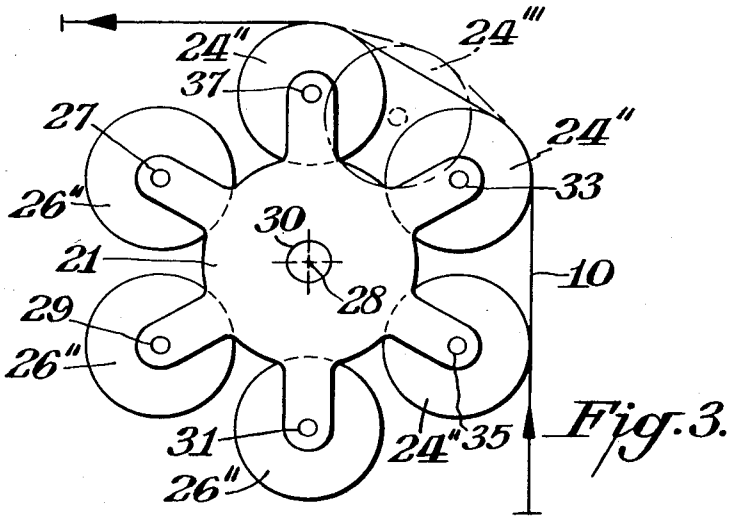
FIG. 3 is a diagrammatic representation of a cluster of rollers in accordance with another alternative embodiment of this invention comprising three support and three blotting rollers.

With reference to FIG. 1 there is shown in greatly simplified form a known web handling arrangement of rollers which incorporates two clusters of rollers constructed in accordance with the present invention. As may be seen, a web 10 is unwound from a supply roll 12 and driven through a coating and drying station of conventional design generally represented by block 14. A second web 10' wound on a second supply roll 12' is adapted to have its leading edge spliced to the trailing edge of the web 10 without stopping or slowing the web 10 by equipment of conventional design (not shown). The web 10 has an outside surface 16 and in inside surface 18. During its passage through the coating section of station 14, a liquid layer is coated on the outside surface 16. Using air floatation, the web is transported and dried in the dryer section (not shown) of station 14. After exiting station 14, the web direction may be altered using a guide roller 20 which is also a support roller. These rollers, not shown in detail in this drawing, usually are stainless steel and have a machined and chrome plated outer surface.

Roller 20 contacts the inside surface 18 of the web 10 which has not been coated by any material. Often, due to space limitations and the like, it is necessary to redirect the web 10 in another (opposite) direction. For this purpose, it, may be necessary to contact the outside surface 16 of the web which now bears a coated layer that was dried during its passage through station 14. The web 10 is redirected first to the horizontal and then vertically down (in the drawing) by running the web over respective clusters of rollers 22 and 22'. During the passage of the web, respective pairs of rollers 24 and 24' support the web 10. These support rollers are free wheeling rollers similar in construction to the guide roller 20. Another support roller 34 may be placed to guide the web 10 to a windup station 36. Not shown in this diagram, but typically present in any such web handling system are at least one pair of are drive rollers placed along the web path which drive the web from the unwinding roller 12 to the windup roller 36 or other web processing arrangement. These arrangements are well known in the art and not subject of this invention.

In accordance with this invention, the problem of wet regions near web splices is solved by placing additional pairs of blotting rollers 26, 26' in the respective clusters 22, 22'. Rollers 26 are blotting rollers having a liquid absorbing outer surface. That outer surface may be a cloth layer wrapped around the rollers, the cloth preferably being cotton or polyester even though other absorbing materials may be used. Or, the rollers may have an outer sleeve of an absorbing material which may be removable or washable. If that cloth is wrapped around the rollers in multiple overlapping turns, the cloth may be replaced simply by unwinding and removing the soiled one and replacing it by winding a new one on the rollers without dismounting the rollers.

A pair of rollers preferable are used in each cluster for each of the support and blotting rollers so that the web is not bent too sharply all at once. Each roller is displaced equiangularly (here 90°) from the others and equiradially to reduce disturbances to the web as the clusters are rotated. The respective clusters 22, 22' are positioned to be rotated about axes 28, 28' to position either the support rollers 24, 24' or the blotting rollers 26, 26' against the web.

For this prupose, a splice detector 44, which may be a light transmission detector, is placed at a location adjacent the web entry to the coating station 14 to detect the presence of a splice. The splice connects the trailing edge of web 10 as it is unwound from one supply roll 12 to the leading edge of another web 10' unwound from a second supply roll 12', as described. The detector 44 communicates through a line 42 to a control device 40 which is capable of determining not only the presence of a splice, but knowing the web speed, the time the splice will reach particular points along the web path through the web handling system. The controller sends a signal to the respective cluster rotating mechanism 32, 32' which act through suitable mechanical linkages 30, 30' to rotate the respective clusters 22, 22' by 180°.

Following passage of the splice through the coating station 14, a section of heavier coating will be present on the web portion trailing the splice. This heavier coating typically will not be completely dried in the dryers following the coating station, but will be still wet as it exits that station. This presents no problem at the first turnaround around point, i.e., around guide roller 20, since the roller contacts the uncoated inside web surface 18. This is not the cast, however, where the web is redirected by the clusters 22, 22'. Here, the outside wet outside web surface 16 contacts rollers 24. A certain amount of the wet material on the web transfer onto the rollers 24 and again from the rollers 24 back on to the web, ruining portions of otherwise good material. Furthermore, if some of that wet material is still wet during the wind up process on windup roll 36, upon subsequent drying it will act as a glue to stick the web layers together and impede unwinding for further processing of the web.

As a splice approaches the cluster of rollers 22, a signal from the controller 40 through connection 38 is sent to cluster rotating mechanisms 32, 32'. These mechanisms 32, 32' may be simply a servo or stepping motor, which operates through the linkages 30, 30' to rotate on demand the clusters 22, 22' around axes 28, 28'. Following receipt of the signal, the cluster rotating mechanisms 32, 32' rotate the clusters of rollers by 180° bringing the sets of blotting rollers 26, 26' in contact with the coated side 16 of the web, replacing support rollers 24, 24'. When the splice is past the clusters (a function of time depending on web speed), they are rotated on signal from the controller 40 back to their original position with the blotting rollers out of contact with the web. The controller may be any suitable device capable of driving the mechanisms in response to a signal E from the splice detector 44. Preferably a microprocessor is used for this purpose. In cases where web speeds of 150 to 400 feet per minute are used, the rotation of the roller clusters 28, 28' to replace rollers 24, 24' by rollers 26, 26' in supporting and blotting the web typically occurs in a period of 1 and 2 seconds, or less depending on the spacing of the clusters.

The system described above employs a cluster of four rollers, two support and two blotting rollers. It has been found that at least three rollers must be used to provide an adequate cluster with acceptable path lenght changes during cluster rotation. If only two rollers (one support, one blotting) were used, web tension is lost in the system because of these momentary changes in the path length of the web travel during the rotation of the two roller clusters. As a result, a perturbation is created in the drive whcih can affect the coating quality of the webs tracking in the whole line. It can be shown that this perturbation can exceed 40% of the path length of the web between adjacent rollers. Three rollers produce a smaller, acceptable perturbation-typically 15%. Nevertheless, three rollers are not preferred because two support rollers and a single blotting roller are used. When the single blotting roller is in use the web changes direction 90°. While acceptable it is preferred that such sharp changes be avoided insofar as possible.

Figure 2:
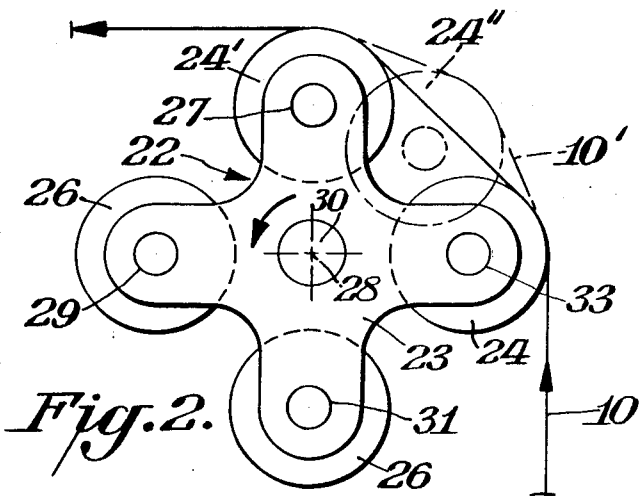
FIG. 2 is a diagrammatic representation of the cluster of rollers depicted in FIG. 1 comprising two supporting and two blotting rollers.

In FIG. 2 there is shown an enlarged view of one of the clusters of rollers 22 comprising the four rollers 24, 26 seen in FIG. 1. A mounting block 23 supports the four rollers 24 and 26 at equiangular positions and equiradial distances with respect to the axis of rotation 28. The block 23 is rotated by mechanical linkage in the form of a shaft 30 around the axis 28 through its center. Each of the rollers 24 and 26 is rotatably mounted on the respective shafts 27, 29, 31 and 33 which in turn are suitably mounted on the mounting block 23. The support rollers 24 each contact an equal section of the web 10. When the cluster 22 is rotated 180°, the blotting rollers 26 are substituted for the support rollers 24. As the cluster 22 is rotated about the axis 28, one of the rollers 24 or 26 during transit reaches the position shown in phantom lines as roller 24''. The path of the web as its path lengthens slightly during the rotation of the cluster, is shown in phantom lines 10'. At the maximum lengthening point, the rollers 24 are rotated roughtly 45° from their normal positions. The length of the path of the web in the rest position and in the maximum lengthened position during the rotation of the cluster may be calculated to determine the path length increase. The variation in path length when four rollers are used in a cluster can thus be shown to be approximately 10 percent. Such variation is quite acceptable as is the three roller cluster; they do not produce major perturbations in the web 10.

One would expect that increasing the number of rollers in a cluster would continuously decrease the variation of the web path and provide a continuing improvement in this regard; this is so. However, as is shown with reference to FIG. 1, in which a cluster comprising six rollers is depicted, an increase in the number of rollers creates a different problem. This cluster of six which comprises a support 21' having peripherally located three adjacent support rollers 24'' and three adjacent blotting rollers 26'' freely rotating around shafts 27, 29, 31, 33, 35 and 37 generates a web path length change, when rotated 180° to switch from support to blotting rollers, which is approximatley equal to only 4%. However as is seen in the drawing, in order to obtain a 90° change of direction for the web, three rollers 24'' contact the web 10, but the web wraps around only a small sector of each roller. As a result, there is insufficient wraparound of the web 10 over these outside rollers 24 to drive the roller, i.e., cause rotation thereof. Without proper rotational speed, the web maintains a slipping contact with the web surface. The rollers should be rotating at a speed that is constant and equal to the surface speed of the web. Thus, the outside rollers 24 may, and indeed often do, scratch the surface of the web as the web rubs against it. Experience indicates that it is desirable to have a minimum of more than 10° wrap around for the web to provide reliable driving without slippage of the supporting rollers. Thus, while it is acceptable in some instances to use a cluster of three rollers (one blotting roller) or six rollers, generally clusters of four (or five) are preferred.

In a typical installation comprising four rollers the distance between the rotation center 28 and the axis of each of the rollers is about 10.4 cm. In that case, roller diameters are selected to be of the order of 9.9 cm.

Those skilled in the art having the benefits of the teachings of the instant invention as hereinabove set forth may effect numerous modifications thereto. Such modifications are to be construed as lying within the contemplation of the instant invention as defined in the appended claims.

I claim:

1. A method of reducing contamination of support rollers in web handling system in which a moving web has incompletely dried portions comprising the steps of:

passing the moving web over a support means comprising at least a first support means and a second supporting and blotting means, determining when an incompletely dried portion of the moving web passes over the first support means, and blotting the web by substituting a second supporting and blotting means for the first support means during the period the incompletely dried portion passes over the first support means.

2. A method as set forth in claim 1 wherein both the first support means and the second supporting and blotting means are positioned rotatably about an axis of rotation parallel to the plane of the web to form a cluster of at least three rollers each positioned equiangularly and equiradially about the axis of rotation.

3. A method as set forth in claim 2 wherein the cluster comprises two support and two blotting rollers.

4. A method as set forth in claim 3 wherein the blotting rollers are adjacent each other.

5. A method as set forth in claim 4 wherein the blotting rollers comprise a removable blotting surface.

6. A method as set forth in claim 2 wherein the blotting rollers comprise a removable blotting surface.

7. A system having support rollers for supporting a moving coated web and reducing contamination of the support rollers by incompletely dried portions on the web comprising:

a first support means for the web a second supporting and blotting means for the web, and means for substituting the second supporting and blotting means for the first support means during the period of time that the incompletely dried portions of the web would normally pass over the support means.

8. A system as set forth in claim 7 which includes a determining means for generating a signal indicative of the passage of the incompletely dried portions over the first support means, the substituting means being responsive to the signal to effect the substitution.

9. A system as set forth in claim 8 wherein both the first support means and second supporting and blotting means are positioned rotatably about an axis of rotation parallel to the plane of the web to form a cluster of at least three rollers each positioned equiangularly and equiradially about the axis of rotation.

10. A system as set forth in claim 9 wherein the cluster comprises two support and two blotting rollers.

11. A system as set forth in claim 10 wherein the blotting rollers are adjacent each other.

12. A system as set forth in claim 11 wherein the blotting rollers comprise a removable blotting surface.

13. A system as set forth in claim 7 where the first support means and the means for substituting comprises a pivoted cluster of at least three rollers at least one of which has a blotting surface, and means to pivot the cluster to selectively contact the web with different ones of the rollers.

14. A system as set forth in claim 13 which includes a determining means for generating a signal indicative of the passage of the incompletely dried portions over the first support means, the substituting means being responsive to the signal to effect the substitution.

15. A system as set forth in claim 14 wherein the cluster comprises two support and two blotting rollers.

* * * * *